US007686920B2

(12) United States Patent
Levit et al.

(10) Patent No.: US 7,686,920 B2
(45) Date of Patent: Mar. 30, 2010

(54) FIBRILLATED POLYPYRIDOBISIMIDAZOLE FLOC

(75) Inventors: Mikhail R. Levit, Glen Allen, VA (US); Achim Amma, Richmond, VA (US); Edmund A. Merriman, Midlothian, VA (US)

(73) Assignee: E.I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 12/084,006

(22) PCT Filed: Dec. 19, 2006

(86) PCT No.: PCT/US2006/062284

§ 371 (c)(1),
(2), (4) Date: Apr. 23, 2008

(87) PCT Pub. No.: WO2007/076343

PCT Pub. Date: Jul. 5, 2007

(65) Prior Publication Data

US 2009/0078383 A1 Mar. 26, 2009

Related U.S. Application Data

(60) Provisional application No. 60/752,929, filed on Dec. 21, 2005.

(51) Int. Cl.
*D21F 11/00* (2006.01)

(52) U.S. Cl. ..... 162/157.3; 162/157.1

(58) Field of Classification Search ..... 162/141, 162/146, 157.1, 157.3, 164.3
See application file for complete search history.

(56) References Cited

U.S. PATENT DOCUMENTS

| | | | | |
|---|---|---|---|---|
| 4,698,267 | A * | 10/1987 | Tokarsky | 428/474.4 |
| 5,674,969 | A * | 10/1997 | Sikkema et al. | 528/183 |
| 5,833,807 | A * | 11/1998 | Ramachandran et al. | 162/157.3 |
| 2003/0022961 | A1 * | 1/2003 | Kusaka et al. | 523/152 |
| 2006/0287475 | A1 * | 12/2006 | Allen et al. | 528/272 |

* cited by examiner

*Primary Examiner*—Eric Hug
*Assistant Examiner*—Jacob Thomas Minskey

(57) ABSTRACT

The invention concerns a process for making a fibrillated polypyridobisimidazole floc comprising the steps of: cutting polypyridobisimidazole filaments to an average cut length of from about 0.5 to 10 mm; and applying energy to the polypyridobisimidazole filaments to produce a fibrillated floc having essentially the same average cut length after the application of energy as before the application of energy; where the fibrillated floc having a Canadian Standard Freeness (CSF), when dispersed in water by itself, of from about 400 to 750 ml.

20 Claims, 2 Drawing Sheets

FIBRILLATED POLYPYRIDOBISIMIDAZOLE FLOC

CROSS REFERENCE TO RELATED APPLICATIONS

This application claims benefit of U.S. Application No. 60/752,929 filed Dec. 21, 2005, the disclosure of which is incorporated herein by reference.

FIELD OF THE INVENTION

The disclosure relates generally to a method of producing fibrillated polypyridobisimidazole floc and papers made from such floc.

BACKGROUND OF THE INVENTION

Fibrillated fibers have been used in the production of paper. Fibrillation of aramid floc is typically performed in a disk refiner. However, in the standard process, a refiner not only fibrillates the floc but also cuts the floc, reducing the length of the floc and forming what has been call pulp.

A significant amount of energy is used in producing para-aramid pulp and other pulps from high performance fibers (up to about 8000 kJ/kg).

There is a need for a process for producing floc suitable for use in papers that can be formed without reducing the average length of the fiber and can be performed at a lower energy usage.

SUMMARY OF THE INVENTION

In some embodiments, the invention concerns a process for making a fibrillated polypyridobisimidazole floc comprising:

providing polypyridobisimidazole filaments having an average cut length of from about 0.5 to 10 mm; and applying energy to the polypyridobisimidazole filaments to produce a fibrillated floc; where the fibrillated floc has essentially the same average cut length after the application of energy as before the application of energy;

the fibrillated floc having a Canadian Standard Freeness (CSF), when dispersed in water by itself, of from about 400 to 750 ml.

In some embodiments, the energy is applied by agitation. In certain embodiments, the polypyridobisimidazole filaments are contacted with a fluid to form a dispersion and the energy is applied to the dispersion containing the polypyridobisimidazole filaments. In some embodiments, the energy is applied to the dispersion by pumping the dispersion.

In some embodiments, the amount of energy applied to the polypyridobisimidazole filaments to make the fibrillated floc is from 360 to 3600 kJ/kg.

One preferred fluid is water. One polypyridobisimidazole is PIPD. In some embodiments, the polypyridobisimidazole filaments have an average cut length of from about 1 to 1.5 mm.

In some aspects, the invention concerns a process for making paper comprising:

providing polypyridobisimidazole filaments, said filaments having an average cut length of from about 0.5 to 10 mm; and applying energy to the polypyridobisimidazole filaments to produce a fibrillated floc; the fibrillated floc having essentially the same average cut length after the application of energy as before the application of energy; the fibrillated floc having a Canadian Standard Freeness (CSF), when dispersed in water by itself, of from about 400 to 750 ml;

contacting the fibrillated floc with water to form a dispersion; and removing at least a portion of the water from the dispersion to yield paper.

In some embodiments, a portion of the water is removed from the dispersion via a screen or wire belt to produce a wet water and the wet paper is dried. In certain embodiments, the process comprises the additional step of densifying the paper composition by calendering or compression at some point in the process.

Some processes further comprise a binder material. In some embodiments, the binder material comprises non granular, fibrous or film-like, meta-aramid fibrids having an average maximum dimension of 0.2 to 1 mm, a ratio of maximum to minimum dimension of 5:1 to 10:1, and a thickness of no more than 2 microns. In some embodiments, the binder material comprises thermoplastic or thermoset resins in the form of suspensions, emulsions, solutions, powders, flakes or fibers.

In some embodiments, the process comprises the additional step of heat treating the paper composition at or above the glass transition temperature of the binder material. In certain embodiments, the heat treatment is either followed by or includes calendering the paper composition.

The invention also relates to a fibrillated polypyridobisimidazole floc having cut length of from 0.5 to 10 mm and Canadian Standard Freeness of from about 400 to about 750 ml., when dispersed by itself in water. In some embodiments, the fibrillated polypyridobisimidazole floc has a cut length of from about 1 to 1.5 mm. In certain embodiments, the fibrillated polypyridobisimidazole floc comprises PIPD.

BRIEF DESCRIPTION OF THE DRAWINGS

Embodiments are illustrated in the accompanying figures to improve understanding of concepts as presented herein.

Figure 1:
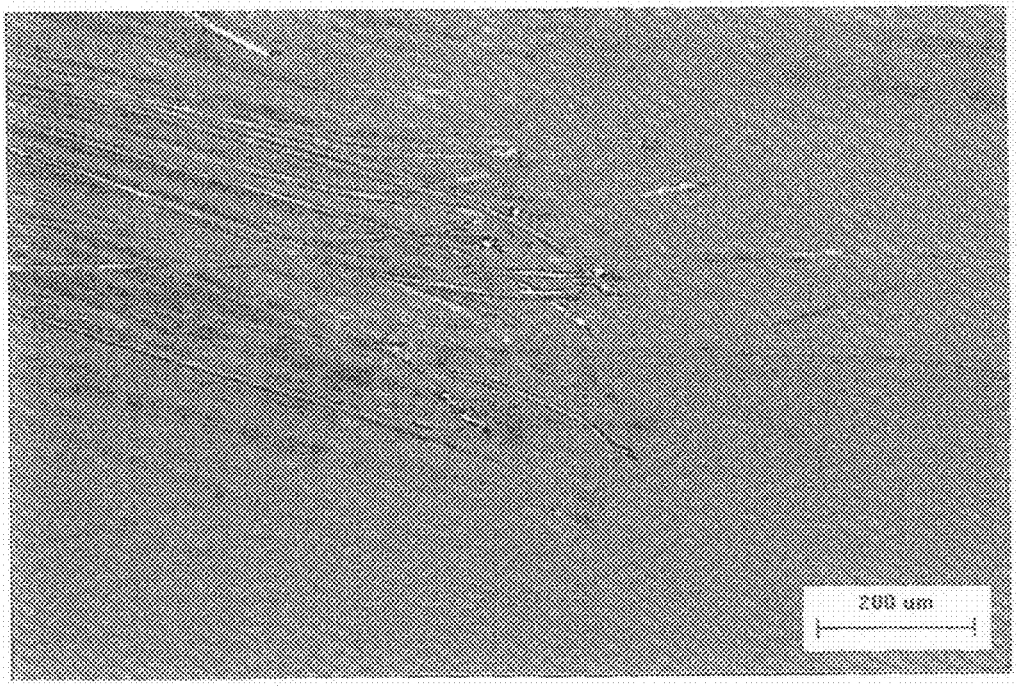
FIG. 1 shows PIPD floc prior to fibrillation.

The figures are provided by way of example and are not intended to limit the invention.

DETAILED DESCRIPTION OF ILLUSTRATIVE EMBODIMENTS

In some embodiments, the invention concerns a process for making a fibrillated polypyridobisimidazole floc comprising:

providing polypyridobisimidazole filaments having an average cut length of from about 0.5 to 10 mm; and applying energy to the polypyridobisimidazole filaments to produce a fibrillated floc; where the fibrillated-floc ha essentially the same average cut length after the application of energy as before the application of energy;

the fibrillated floc having a Canadian Standard Freeness (CSF), when dispersed in water by itself, of from about 400 to 750 ml.

It has been discovered that if PIPD short fibers or floe are stirred in water, the short fibers readily fibrillate to a very high degree. It is further observed that PIPD floc fibrillates more readily than aramid floe with surprisingly little shear or energy being imparted into the fibers. Previously, to obtain this amount of fibrillation with aramid floe, the floc would need to be refined, for example, in a disk refiner. However, at the standard operation, a refiner not only fibrillates the floc but also cuts the floc, reducing the length of the floc and forming what is commonly referred to as pulp. The practice of this invention results in a true fibrillated floc that has essentially the same average length as the starting floc. The amount of energy, which is necessary to apply to the floc to achieve fibrillation is about from 360 to 3600 kJ/kg. This is below the level of energy used for making para-aramid pulp and pulps from other high performance fibers (up to 8000 kJ/kg).

By essentially the same average length we mean that length of the fibrillated floc and length of the initial/raw floc are the same at 95% confidence level.

The floc of this invention means short lengths of fiber, shorter than staple fiber. The length of floc is about 0.5 to about 15 mm and a diameter of 4 to 50 micrometers, preferably having a length of 1 to 12 mm and a diameter of 8 to 40 micrometers. Floc that is less than about 1 mm does not add significantly to the strength of the material in which it is used. Floc or fiber that is more than about 15 mm often does not function well because the individual fibers may become entangled and cannot be adequately and uniformly distributed throughout the material or slurry. Floc is generally made by cutting continuous spun filaments or tows into specific-length pieces using conventional fiber cutting equipment Generally this cutting is made without significant or any fibrillation of the fiber.

For the purpose of this invention, "Papers" are flat sheets producible on a paper machine, such as a Fourdrinier or inclined-wire machine. In preferred embodiments these sheets are generally thin, fibrous sheets comprised of a network of randomly oriented, short fibers laid down from a water suspension and bonded together by their own chemical attraction, friction, entanglement, binder, or a combination thereof. The paper can have basis weight from about 10 to about 700 g/m2 and a thickness from about 0.015 to about 2 mm.

The floc of this invention has fibrils. Fibril means a small fiber having a diameter as small as a fraction of a micrometer to a few micrometers and having a length of from about 10 to 100 micrometers. The fibrillated floc of this invention has fibrils generally extending from the main larger floc fiber. Fibrils act as hooks or fasteners to ensnare and capture adjacent material.

The instant invention utilizes polypyridobisimidazole fiber. This fiber is made from a rigid rod polymer that is of high strength. The polypyridobisimidazole polymer of this fiber has an inherent viscosity of at least 20 dl/g or at least 25 dl/g or at least 28 dl/g. Such fibers include PIPD fiber (also known as M5® fiber and fiber made from poly[2,6-diimidazo[4,5-b:4,5-e]-pyridinylene-1,4(2,5-dihydroxy)phenylene). PIPD fiber is based on the structure:

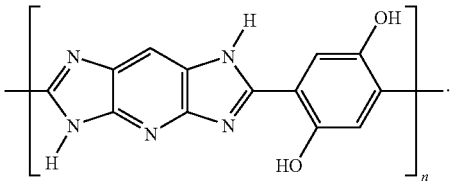

Polypyridobisimidazole fiber can be distinguished from the well known commercially available PBI fiber or polybenzimidazole fiber in that that polybenzimidazole fiber is a polybibenzimidazole. Polybibenzimidazole fiber is not a rigid rod polymer and has low fiber strength and low tensile modulus when compared to polypyridobisimidazoles.

PIPD fibers have been reported to have the potential to have an average modulus of about 310 GPa (2100 grams/denier) and an average tenacity of up to about 5.8 Gpa (39.6 grams/denier). These fibers have been described by Brew, et al. *Composites Science and Technology* 1999, 59, 1109; Van der Jagt and Beukers, *Polymer* 1999, 40, 1035; Sikkema, *Polymer* 1998, 39, 5981; Klop and Lammers, *Polymer,* 1998, 39, 5987; Hageman, et al., *Polymer* 1999, 40, 1313.

One method of making rigid rod polypyridoimidazole polymer is disclosed in detail in U.S. Pat. No. 5,674,969 to Sikkema et al. Polypyridoimidazole polymer may be made by reacting a mix of dry ingredients with a polyphosphoric acid (PPA) solution. The dry ingredients may comprise pyridobisimidazole-forming monomers and metal powders. The polypyridobisimidazole polymer used to make the rigid rod fibers used in the fabrics of this invention should have at least 25 and preferably at least 100 repetitive units.

For the purposes of this invention, the relative molecular weights of the polypyridobisimidazole polymers are suitably characterized by diluting the polymer products with a suitable solvent, such as methane sulfonic acid, to a polymer concentration of 0.05 g/dl, and measuring one or more dilute solution viscosity values at 30° C. Molecular weight development of polypyridobisimidazole polymers of the present invention is suitably monitored by, and correlated to, one or more dilute solution viscosity measurements. Accordingly, dilute solution measurements of the relative viscosity ("$V_{rel}$" or "$\eta_{rel}$" or "$n_{rel}$") and inherent viscosity ("$V_{inh}$" or "$\eta_{inh}$" or "$n_{inh}$") are typically used for monitoring polymer molecular weight. The relative and inherent viscosities of dilute polymer solutions are related according to the expression $$V_{inh}=\ln(V_{rel})/C,$$

where ln is the natural logarithm function and C is the concentration of the polymer solution. $V_{rel}$ is a unitless ratio of the polymer solution viscosity to that of the solvent free of polymer, thus $V_{inh}$ is expressed in units of inverse concentration, typically as deciliters per gram ("dl/g"). Accordingly, in certain aspects of the present invention the polypyridobisimidazole polymers are produced that are characterized as providing a polymer solution having an inherent viscosity of at least about 20 dl/g at 30° C. at a polymer concentration of 0.05 g/dl in methane sulfonic acid. Because the higher molecular weight polymers that result from the invention disclosed herein give rise to viscous polymer solutions, a concentration of about 0.05 g/dl polymer in methane sulfonic acid is useful for measuring inherent viscosities in a reasonable amount of time.

Exemplary pyridobisimidazole-forming monomers useful in this invention include 2,3,5,6-tetraaminopyridine and a variety of acids, including terephthalic acid, bis-(4-benzoic acid), oxy-bis-(4-benzoic acid), 2,5-dihydroxyterephthalic acid, isophthalic acid, 2,5-pyridodicarboxylic acid, 2,6-napthalenedicarboxylic acid, 2,6-quinolinedicarboxylic acid, or any combination thereof. Preferably, the pyridobisimidazole forming monomers include 2,3,5,6-tetraaminopyridine and 2,5-dihydroxyterephthalic acid. In certain embodiments, it is preferred that that the pyridoimidazole-forming monomers are phosphorylated. Preferably, phosphorylated pyridoimidazole-forming monomers are polymerized in the presence of polyphosphoric acid and a metal catalyst.

Metal powders can be employed to help build the molecular weight of the final polymer. The metal powders typically include iron powder, tin powder, vanadium powder, chromium powder, and any combination thereof.

The pyridobisimidazole-forming monomers and metal powders are mixed and then the mixture is reacted with polyphosphoric acid to form a polypyridoimidazole polymer solution. Additional polyphosphoric acid can be added to the polymer solution if desired. The polymer solution is typically extruded or spun through a die or spinneret to prepare or spin the filament.

The fibrillated floc of this invention is made by applying energy to the polypyridobisimidazole filaments to produce a fibrillated floc; where the fibrillated floc has essentially the same average cut length after the application of energy as before the application of energy. In some embodiments, the energy is applied by agitation, such as by an impeller or a rotor in a mixer or other mixing vessel. In certain embodiments, the polypyridobisimidazole filaments are contacted with a fluid to form a dispersion and the energy is applied to the dispersion containing the polypyridobisimidazole filaments. In some embodiments, the energy is applied to the dispersion by pumping the dispersion. Any suitable method that imparts energy that forces the floc pieces to come in contact repeatedly with other floe pieces or with a solid surfaces without cutting the floc may be used in the process of this invention. In a preferred embodiment the amount of energy or shear is applied to the outer surface of the floc in an about 360 to 3600 kJ/kg of floc.

Test Method

The following test method was used in the Examples.

Canadian Standard Freeness (CSF) is a well-known papermakers' measure of the facility for water to drain through a calibrated screen from a slurry or dispersion of pulp or fibers. Freeness is measured by TAPPI test T227. It mimics what happens as a fiber/particle/water slurry forms paper on the moving screen of a paper machine. Data obtained from conduct of that test are expressed as Canadian Standard Freeness Numbers, which are the milliliters of water that drain from an aqueous slurry under specified conditions. A large number, i.e., a high freeness, indicates that water drains rapidly through the fiber pad accumulating on the screen. A low number indicates that the fiber slurry drains slowly. Water without fiber gives a CSF of 880 ml, while numbers below 100 ml are questionable, because many short fibers may be passing through the screen. The Schopper-Riegler freeness test is more conclusive for CSF values below 100 ml. The freeness is inversely related to the degree of fibrillation of the fiber, since greater numbers of fibrils reduce the rate at which water drains through a forming paper mat.

Example 1

Figure 2:
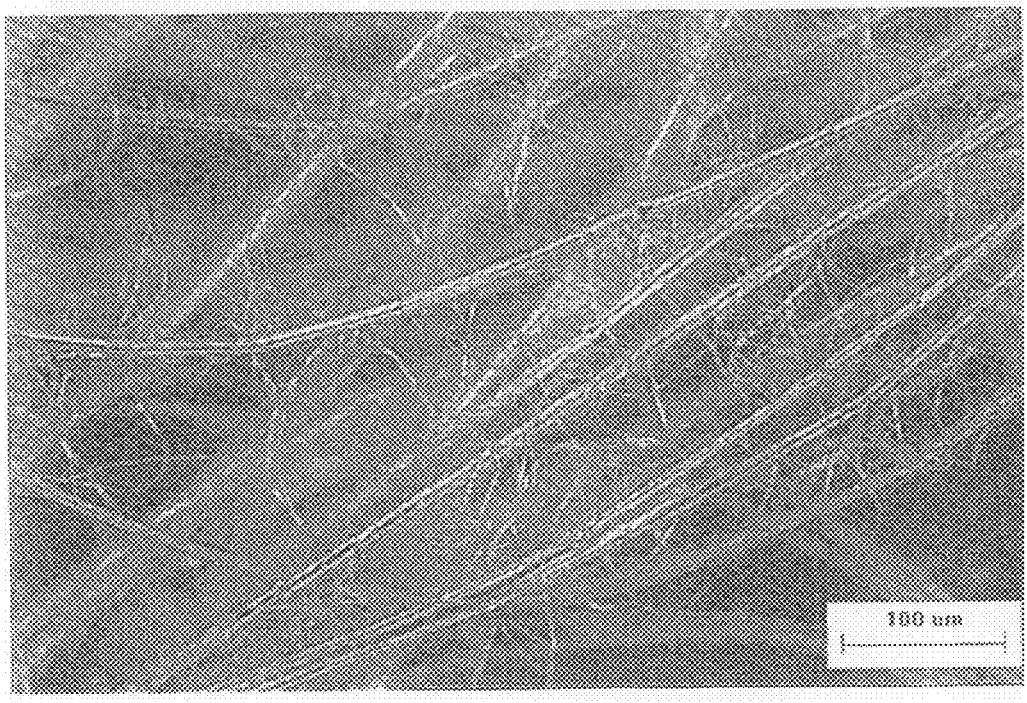
FIG. 2 shows fibrillated PIPD floe having the same average length (about 6.4 mm) as it did prior to fibrillation and has many fibrils coming out of the core fiber stalk.

1.6 grams of PIPD floc with linear density of about 1.5 dpf (0.17 tex) and an average length of about 6.4 mm (see FIG. 1) were placed in a laboratory pulp disintegrator with about 2500 grams of water and the combined contents agitated for 3 minutes to fibrillate the floc. The disintegrator was as described in TAPPI Standard T 205 with three-bladed propeller working at 1750 revolutions per minute and four baffles. After agitation, the fibrillated floc had the same average length of about 6.4 mm and many fibrils coming out of the core fiber stalk (see FIG. 2).

Example 2

Another 1.6 grams of PIPD floc was fibrillated exactly in the same way as in Example 1. The fibrillated floc from Example 1 and this Example were then combined to make an adequate floc sample, and the Canadian Standard Freeness (CSF) was measured. A CSF of 650 ml was determined for the accumulative sample.

What is claimed:

1. A process for making a fibrillated polypyridobisimidazole floc comprising: providing polypyridobisimidazole filaments having an average cut length of from about 0.5 to 10 mm; and applying energy to the polypyridobisimidazole filaments to produce a fibrillated floc; where the fibrillated floc has essentially the same average cut length after the application of energy as before the application of energy; wherein the amount of enemy applied is about 360 to 3600 j/kg the fibrillated floc having a Canadian Standard Freeness (CSF), when dispersed in water by itself, of from about 400 to 750 ml.

2. The process of claim 1 wherein the energy is applied by agitation.

3. The process of claim 1 wherein the polypyridobisimidazole filaments are contacted with a fluid to form a dispersion and the energy is applied to the dispersion containing the polypyridobisimidazole filaments.

4. The process of claim 3 wherein the energy is applied to the dispersion by pumping the dispersion.

5. The process of claim 1 wherein the amount of energy applied to the polypyridobisimidazole filaments to make the fibrillated floc is from 360 to 3600 kJ/kg.

6. The process of claim 3 wherein the fluid is water.

7. The process of claim 1 wherein polypyridobisimidazole is PIPD.

8. The process of claim 1 wherein the polypyridobisimidazole filaments have an average cut length of from about 1 to 1.5 mm.

9. A process for making paper comprising:

providing polypyridobisimidazole filaments, said filaments having an average cut length of from about 0.5 to 10 mm; and applying energy to the polypyridobisimidazole filaments to produce a fibrillated floc; the fibrillated floc having essentially the same average cut length after the application of energy as before the application of energy, wherein the amount of enemy applied is about 360 to 3600 j/kg the fibrillated floc having a Canadian Standard Freeness (CSF), when dispersed in water by itself, of from about 400 to 750 ml;

contacting the fibrillated floc with water to form a dispersion; and removing at least a portion of the water from the dispersion to yield paper.

10. The process of claim 9 wherein a portion of the water is removed from the dispersion via a screen or wire belt to produce a wet water and the wet paper is dried.

11. The process of claim 9 comprising the additional step of densifying the paper composition by calendering or compression at some point in the process.

12. The process of claim 9 further comprising a binder material.

13. The process of claim 9 comprising the additional step of:

heat treating the paper composition at or above the glass transition temperature of the binder material.

14. The process of claim 13 wherein the heat treatment is either followed by or includes calendering the paper composition.

15. The process of claim 9 wherein the polypyridobisimidazole floc has a cut length of from about 1 to 1.5 mm.

16. The process of claim 12, wherein the binder material comprises non granular, fibrous or film-like, meta-aramid fibrids having an average maximum dimension of 0.2 to 1 mm, a ratio of maximum to minimum dimension of 5:1 to 10:1, and a thickness of no more than 2 microns.

17. The process of claim 9 wherein the polypyridobisimidazole is PIPD.

18. A fibrillated polypyridobisimidazole floc having cut length of from 0.5 to 10 mm and Canadian Standard Freeness of from about 400 to about 750 ml, when dispersed by itself in water.

19. The fibrillated polypyridobisimidazole floc of claim 18 having a cut length of from about 1 to 1.5 mm.

20. The fibrillated polypyridobisimidazole floc of claim 18 wherein the polypyridobisimidazole is PIPD.

* * * * *